US005503528A

United States Patent [19]

Glezer et al.

[11] Patent Number: 5,503,528

[45] Date of Patent: Apr. 2, 1996

[54] RIM SEAL FOR TURBINE WHEEL

[75] Inventors: Boris Glezer, Del Mar; Gary L. Boyd, Alpine; Paul F. Norton, San Diego, all of Calif.

[73] Assignee: Solar Turbines Incorporated, San Diego, Calif.

[21] Appl. No.: 173,765

[22] Filed: Dec. 27, 1993

[51] Int. Cl.[6] ..... F01D 5/08; F01D 5/28

[52] U.S. Cl. ..... 416/96 R; 415/115; 415/173.7; 415/200

[58] Field of Search ..... 415/115, 116, 415/136, 139, 173.7, 174.5, 200; 416/46 R

[56] References Cited

U.S. PATENT DOCUMENTS

| | | | |
|---|---|---|---|
| 2,988,325 | 6/1961 | Dawson | 415/116 |
| 3,623,736 | 11/1971 | Petrie | 415/173.7 |
| 3,824,030 | 7/1974 | DeFeo | 415/177 |
| 3,963,368 | 6/1976 | Emmerson | 415/115 |
| 3,966,353 | 6/1976 | Booher, Jr. et al. | 415/116 |
| 3,989,410 | 11/1976 | Ferrari | 415/115 |
| 4,425,079 | 1/1984 | Speak et al. | 415/115 |
| 4,582,467 | 4/1986 | Kisling | 415/115 |
| 4,768,924 | 9/1988 | Carrier et al. | 415/200 |

FOREIGN PATENT DOCUMENTS

| | | | |
|---|---|---|---|
| 2062119 | 5/1981 | United Kingdom | 415/200 |

*Primary Examiner*—Thomas E. Denion
*Assistant Examiner*—Michael S. Lee
*Attorney, Agent, or Firm*—Marshall, O'Toole, Gerstein, Murray & Borun

[57] ABSTRACT

A turbine wheel assembly includes a disk having a plurality of blades therearound. A ceramic ring is mounted to the housing of the turbine wheel assembly. A labyrinth rim seal mounted on the disk cooperates with the ceramic ring to seal the hot gases acting on the blades from the disk. The ceramic ring permits a tighter clearance between the labyrinth rim seal and the ceramic ring.

32 Claims, 4 Drawing Sheets

RIM SEAL FOR TURBINE WHEEL

TECHNICAL FIELD

The present invention relates generally to a gas turbine engine, and more particularly to a rim seal for a turbine wheel of a gas turbine engine.

BACKGROUND ART

"The government of the United States of America has rights in this invention pursuant to Contract No. DE-AC02-92CE40960 awarded by the United States Department of Energy".

In the operation of a gas turbine engine, air at atmospheric pressure is initially compressed by a compressor, and the resulting compressed air is delivered to a combustion stage. In the combustion stage, heat is added to the compressed air leaving the compressor by mixing fuel with the compressed air and by burning the fuel/air mixture. The gas flow resulting from combustion of the fuel/air mixture in the combustion stage expands through a turbine, and some of the energy of the gas flow is used to drive a turbine in order to produce mechanical power.

One form of turbine is an axial turbine having one or more stages, wherein each stage employs one row of stationary nozzle guide vanes and one row of moving blades. The row of moving blades is mounted on a turbine disk. The nozzle guide vanes are aerodynamically designed to direct incoming gas from the combustion stage onto the turbine blades to thereby aerodynamically transfer kinetic energy to the blades.

The combustion gases entering the turbine typically have a gas entry temperature in the range of 850° C. to at least 1250° C. Since the efficiency and work output of the turbine engine are related to the gas entry temperature of the incoming combustion gases, there is a trend in gas turbine engine technology to increase the gas entry temperature. Seals are normally provided on the disk of a high temperature turbine wheel either near the hub of the turbine or near the rim of the disk of the turbine wheel in order to confine these hot gases of the gas turbine engine to a predetermined area of the turbine. If the seals are provided on the disk of the turbine wheel near the hub of the turbine, the hot gases contact a substantially greater surface area of the disk and turbine than if the seals are provided near the rim of the disk of the turbine wheel. Consequently, providing the seals near the hub of the turbine requires a seal support diaphragm and substantially more cooling than is required by providing effective seals near the rim of the disk of the turbine wheel. Therefore, it is advantageous to mount the seals near the rim of the disk of a turbine wheel.

One typical form of a rim seal is a labyrinth rim seal which is mounted on the disk of the turbine wheel near the rim of the disk and which cooperates with a metal stator ring fixed to the housing of the turbine. The labyrinth rim seal, together with the metal stator ring, isolate the hot gases of the gas turbine engine from all or most of the disk area.

The clearance between the labyrinth rim seal affixed to the disk of the turbine wheel and the metal stator ring supported by the housing of the turbine must be large enough to accommodate the different rates of thermal expansion and thermal shrinkage of the metal stator ring against the labyrinth rim seal. These different rates of thermal expansion and thermal shrinkage result, at least in part, from the relative materials, the relative thermal expansion coefficients, and the different masses of the metal stator ring, the labyrinth rim seal, and the structures on which the metal stator ring and the labyrinth rim seal are supported.

That is, a gas turbine engine is manufactured with a room temperature clearance between the metal stator ring and the labyrinth rim seal. During initial operation of the gas turbine engine, the metal stator ring usually expands more rapidly than the labyrinth rim seal primarily because the metal stator ring and its supporting structure has a typically lower mass than does the labyrinth rim seal and the disk to which the labyrinth rim seal is attached. Therefore, the clearance between the metal stator ring and the labyrinth rim seal increases during engine start-up. Then, as the larger mass of the labyrinth rim seal and the disk to which the labyrinth rim seal is attached continues to heat up, the clearance between the labyrinth rim seal and the metal stator ring reduces to a steady state condition.

During shut down of the turbine engine, the metal stator ring shrinks more rapidly than the labyrinth rim seal primarily because the metal stator ring and its supporting structure has a lower mass than does the labyrinth rim seal and the disk to which the labyrinth rim seal is attached. Therefore, the clearance between the metal stator ring and the labyrinth rim seal shrinks below the steady state clearance. Then, after the gas turbine engine is completely cooled, the clearance between the metal stator ring and the labyrinth rim seal resumes the size of the room temperature clearance.

The steady state clearance between the metal stator ring and the labyrinth rim seal must be sufficiently large to accommodate the different expansion and shrink rates between the lower mass metal stator ring and the higher mass labyrinth rim seal as the gas turbine engine is brought up to, and is shut down from, its steady state operation. However, this large clearance impairs the quality of the seal between the metal stator ring and the labyrinth rim seal during steady state operation of the gas turbine engine. This large clearance results in large quantities of hot gas to flow from the gas path of the gas turbine engine into the cavity surrounding the disk of the turbine wheel. Furthermore, the different expansion rates between the lower mass metal stator ring and the higher mass labyrinth rim seal during initial operation of the gas turbine engine allows even more hot gas from the gas path of the gas turbine engine to flow into the cavity surrounding the disk of the turbine wheel. Therefore, the turbine disk requires a large amount of cooling, and corresponding performance penalties result.

The present invention is directed to overcome one or more of the problems as set forth above.

DISCLOSURE OF THE INVENTION

In accordance with one aspect of the present invention, a turbine wheel assembly includes a blade for reacting to hot gases of a combustor of a turbine engine, a disk supporting the blade so that the blade and disk rotate in reaction to the hot gases, a ceramic ring mounted to a turbine housing, and a sealing means proximate to an outer perimeter of the disk and cooperating with the ceramic ring for sealing the hot gases from the disk.

In accordance with another aspect of the present invention, a turbine wheel assembly includes a turbine wheel having a first portion for reacting to aerodynamic forces, and a second portion for spatially locating the first portion. A sealing means cooperates with a ceramic ring to seal a cavity containing the second portion of the turbine wheel from a cavity containing the first portion of the turbine wheel.

In accordance with yet another aspect of the present invention, a turbine assembly has first and second stages. In the first stage, a first stage blade is arranged to react to hot gases from a combustor of a turbine engine. A first stage disk supports the first stage blade so that the first stage blade and the first stage disk rotate in reaction to the hot gases. A first stage ceramic ring is mounted to a turbine housing. In the second stage, a second stage blade is arranged to react to the hot gases from the combustor of the turbine engine. A second stage disk supports the second stage blade so that the second stage blade and the second stage disk rotate in reaction to the hot gases. A second stage ceramic ring is mounted to the turbine housing. A first stage sealing means is proximate to an outer perimeter of the first stage disk and cooperates with the first and second stage ceramic rings for sealing the first stage disk from the hot gases. A second stage sealing means is proximate to an outer perimeter of the second stage disk and cooperates with the second stage ceramic ring for sealing the second stage disk from the hot gases.

BRIEF DESCRIPTION OF THE DRAWINGS

These and other features and advantages will become more apparent from the following detailed description of the invention when taken in conjunction with the drawings in which.

BEST MODE FOR CARRYING OUT THE INVENTION

Figure 1:
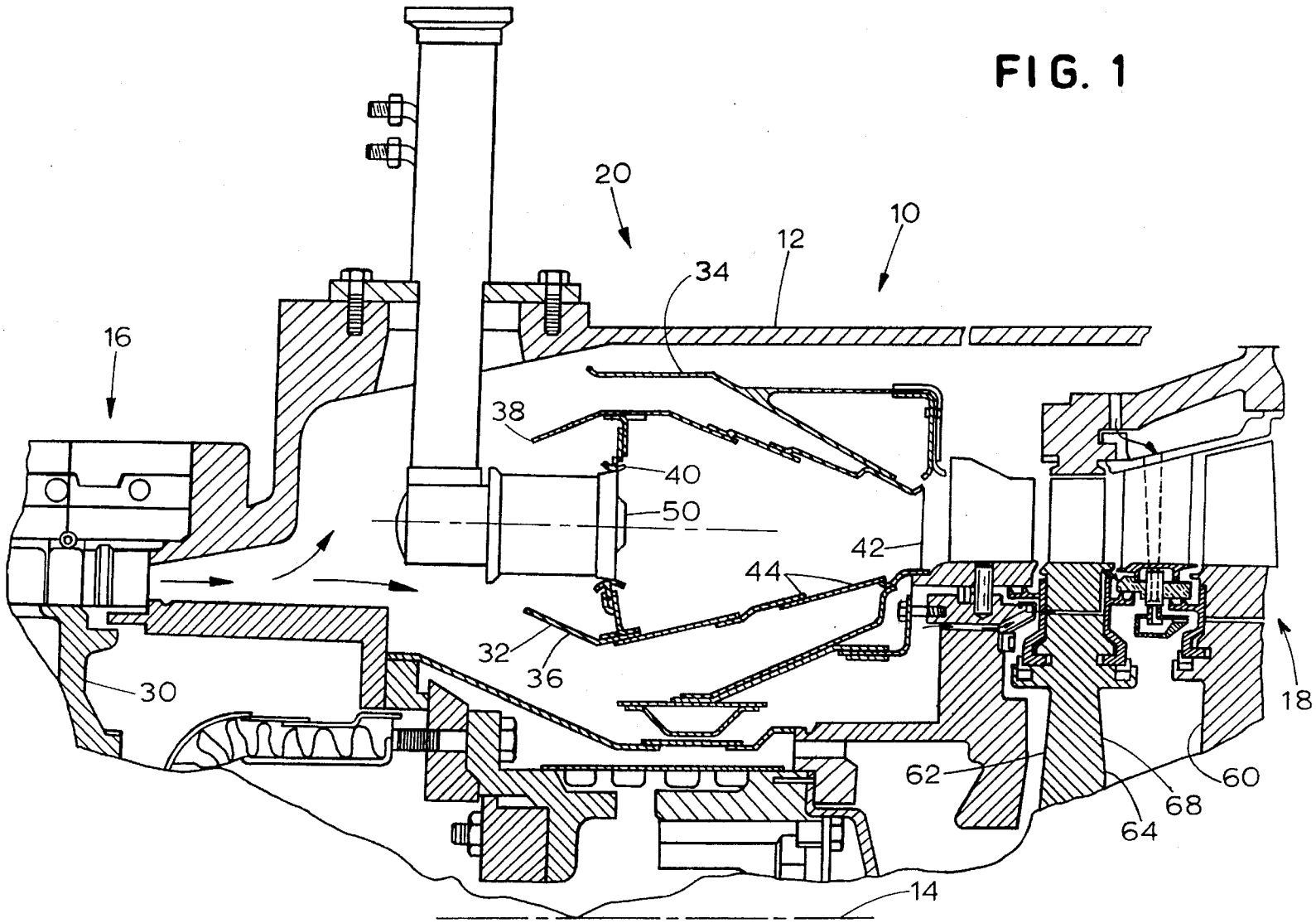
FIG. 1 is a partial sectional side view of a gas turbine engine embodying the present invention.

As shown in FIG. 1, a gas turbine engine 10 has an outer housing 12 and a central axis 14. Positioned within the outer housing 12 and centered about the central axis 14 is a compressor section 16, a turbine section 18, and a combustor section 20 positioned operatively between the compressor section 16 and the turbine section 18.

When the gas turbine engine 10 is in operation, the compressor section 16 causes a flow of compressed air. At least a part of this compressed air is communicated to the combustor section 20. The compressor section 16 may include an axial stage compressor 30 but may, as an alternative, include a radial compressor or any other source for producing compressed air. The combustor section 20 includes an annular combustor 32. The annular combustor 32 has a generally cylindrical outer shell 34 and a generally cylindrical inner shell 36 which are positioned coaxially about the central axis 14. An inlet end 38 of the annular combustor 32 has a plurality of generally evenly spaced openings 40 therein. The annular combustor 32 also has an outlet end 42.

In the arrangement of the gas turbine engine 10 shown in FIG. 1, the annular combustor 32 is constructed of a plurality of generally conical segments 44. Each of the evenly spaced openings 40 has an injector 50 positioned therein. As an alternative to the annular combustor 32, the combustor section 20 may include a plurality of can type combustors.

The turbine section 18 includes a power turbine 60 having one or more stages and having an output shaft, not shown, connected thereto for driving an accessory component such as a generator. Another portion of the turbine section 18 includes a gas producer turbine 62 connected in driving relationship to the compressor section 16.

Figure 2:
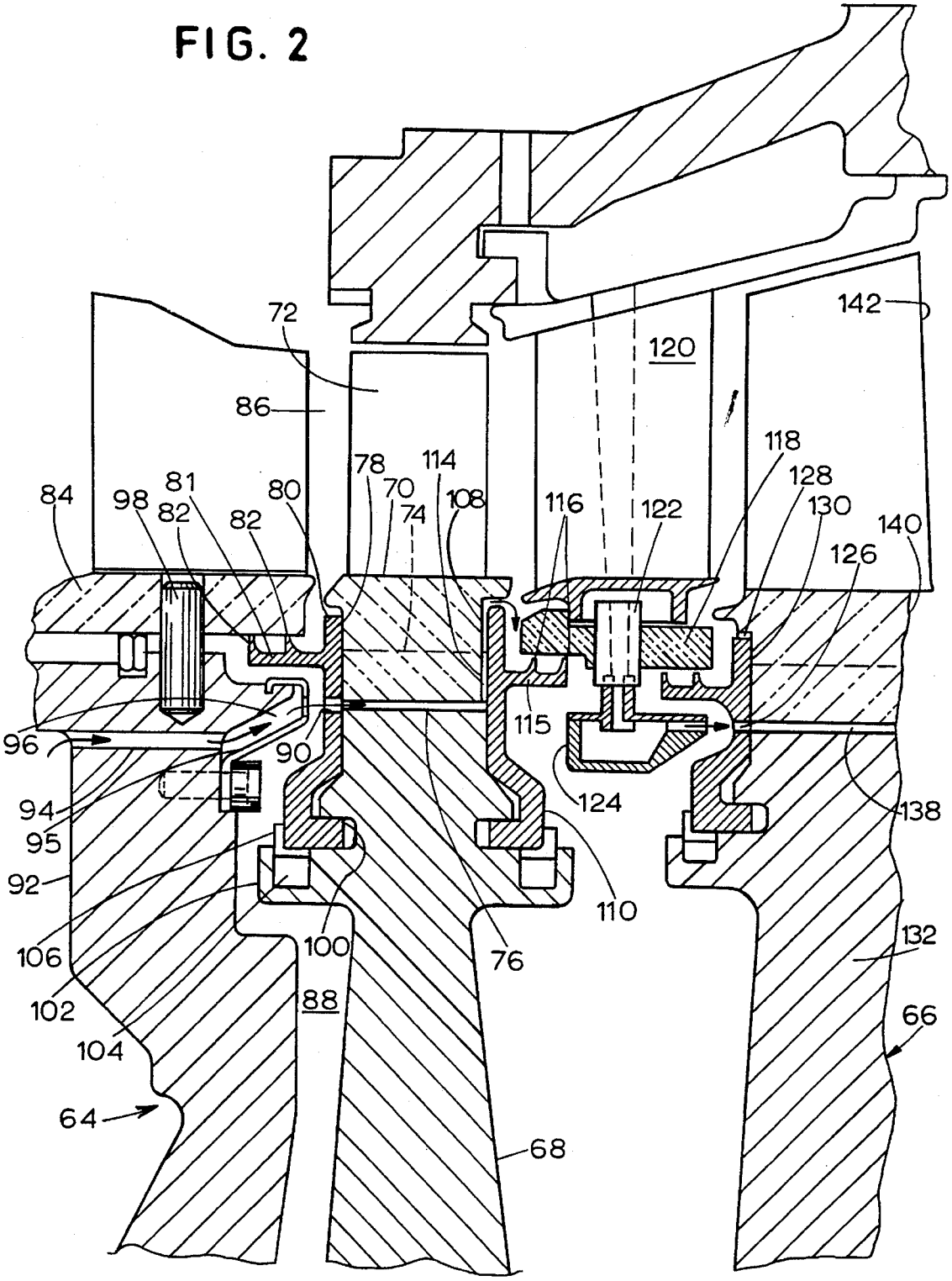
FIG. 2 is an enlarged sectional view of a portion of FIG. 1 and illustrates one embodiment of a sealing arrangement according to the present invention.

As shown in FIGS. 1 and 2, the gas producer turbine 62 includes a first stage turbine wheel assembly 64 and a second stage turbine wheel assembly 66. The first and second stage turbine wheel assemblies 64 and 66 are rotationally positioned about a hub (not shown) which is centered about the central axis 14. The first stage turbine wheel assembly 64 includes a first stage disk 68 suitably attached to the hub. The first stage turbine wheel assembly 64 also includes a first stage retainer 70 which conventionally attaches a plurality of first stage blades, one first stage blade 72 of which is shown in FIG. 2, around an outer perimeter or rim 74 of the first stage disk 68. The first stage disk 68 spatially locates the first stage blades 72 so that the first stage blades 72 receive the hot gases produced by the combustor section 20 of the gas turbine engine 10. The first stage disk 68 transfers the aerodynamic forces of the hot gases acting on the first stage blades 72 to the hub on the which the first stage disk 68 is mounted.

The first stage retainer 70 shown in FIG. 2 may be attached to the first stage disk 68 by a conventional dove tail or fir tree so as to permit a clearance 76 between the first stage retainer 70 and the bottom of a slot in the rim 74 of the first stage disk 68 into which the first stage retainer 70 protrudes. A retainer, such as the first stage retainer 70, may be provided for each of the blades, such as the first stage blade 72, mounted to the first stage disk 68.

Attached around and against a first surface 78 of the first stage disk 68 is a rim seal, such as a first labyrinth rim seal 80 which may be in the shape of an annular ring centered about the central axis 14 of the gas turbine engine 10. The first labyrinth rim seal 80 has an outwardly directed annular flange 81, and the outwardly directed annular flange 81 has a plurality of ridges 82 which cooperate with a first stage ceramic ring 84 in order to provide a seal between a cavity 86 containing the first stage blades, such as the first stage blade 72, and a cavity 88 containing the first stage disk 68. The first labyrinth rim seal 80 and the first stage ceramic ring 84 are centered about the central axis 14.

The first labyrinth rim seal 80 has an opening 90 therethrough which is aligned with the clearance 76. The first labyrinth rim seal 80 has other openings, such as the opening 90, each of which aligns with a clearance, such as the clearance 76, between the first stage disk 68 and the retainers, such as the first stage retainer 70, which attach the other blades of the first stage turbine wheel assembly 64 to the first stage disk 68.

The turbine section 18 of the gas turbine 10 includes a diaphragm 92 having a passageway 94. Compressed air supplied by the compressor section 16 flows through the passageway 94 to a manifold 95 having a nozzle 96 formed therein. As shown in FIG. 2, the nozzle 96 is supported by the diaphragm 92. Accordingly, the diaphragm 92 functions as a nozzle support for the nozzle 96. The nozzle 96 directs compressed air flowing out of the passageway 94 to the opening 90 in the first labyrinth rim seal 80. There may be a plurality of passageways, such as the passageway 94, through the diaphragm 92, and a plurality of nozzles, such as the nozzle 96, in order to direct compressed air supplied by the compressor section 16 to the openings, such as the opening 90, in the first labyrinth rim seal 80. Alternatively, the manifold 95 may be an annular manifold centered about the central axis 14 and having a plurality of nozzles, such as the nozzle 96, for receiving compressed air from one or more passageways, such as the passageway 94, and for directing the compressed air to the openings, such as the opening 90, in the first labyrinth rim seal 80. This compressed air flows through the clearances, such as the clearance 76, between the first stage disk 68 and the retainers, such as the first stage retainer 70, which attach the other blades of the first stage turbine wheel assembly 64 to the first stage disk 68. Thus, the compressed air acts as a coolant to cool the rim of the first stage disk 68.

The diaphragm 92 and the first stage ceramic ring 84 are positioned relative to one another within the gas turbine engine 10 by a floating positioning pin 98. The floating positioning pin 98 accommodates relative movement between the diaphragm 92 and the first stage ceramic ring 84 due thermal expansion and thermal shrinkage.

The first labyrinth rim seal 80 has an inwardly directed annular flange 100 which protrudes into a corresponding annular recess in the first surface 78 of the first stage disk 68. The first stage disk 68 also includes an annular wall 102 forming an annular recess 104. An annular retainer, or a plurality of retainer 106 between the annular wall 102 and the first labyrinth rim seal 80 retains the first labyrinth rim seal 80 on the first surface 78 of the first stage disk 68. Alternatively, the first labryinth rim seal 80 may be retained on the first stage disk 68 by one or more bolts, or the first labyrinth rim seal 80 may be formed integrally with the first stage disk 68.

The first stage disk 68 has a second surface 108. A second rim seal, such as a second labyrinth rim seal 110, may be similar to the first labyrinth rim seal 80 and may be similarly retained on the second surface 108 of the first stage disk 68. The second labyrinth rim seal 110 does not have an opening such as the opening 90 in the first labyrinth rim seal 80. Instead, a channel 114 between the first stage retainer 70 and the second labyrinth rim seal 110 cooperates with the clearance 76 in order to provide an egress for the compressed air flowing through the clearance 76. Accordingly, compressed air flows through the passageway 94, the nozzle 96, the opening 90 in the first labyrinth rim seal 80, the clearance 76, the channel 114, and out between the first stage retainer 70 and the second labyrinth rim seal 110 into the cavity 86 where the air exiting the channel 114 joins with the hot gases in the cavity 86.

The second labyrinth rim seal 110 has an outwardly directed annular flange 115, and the outwardly directed annular flange 115 has a plurality of ridges 116 which cooperate with a second stage ceramic ring 118 in order to provide a seal between the cavity 86 containing the first stage blade 72 and the cavity 88 containing the first stage disk 68. The second stage ceramic ring 118 is supported by a manifold 120 shown partially in cross-section.

A nozzle 122 protrudes through the second stage ceramic ring 118 to discharge compressed air from the manifold 120 to a manifold 124. The manifold 124 directs the compressed air from the nozzle 122 to an opening 126 in a third rim seal, such as a third labyrinth rim seal 128. The first, second, and third labyrinth rim seals 80, 110, and 128 may be metallic, and may be formed from the same metal as is used in fabricating the first stage disk 68.

The third labyrinth rim seal 128 may conveniently be identical to the first labyrinth rim seal 80 and may be similarly retained against a surface 130 of a second stage disk 132. The opening 126 in the third labyrinth rim seal 128 cooperates with a clearance 138 between the second stage disk 132 and a second stage retainer 140 which retains a second stage blade 142 to the second stage disk 132. The second stage retainer 140 may be attached to the second stage disk 132 in conventional fashion. As in the case of the first stage turbine wheel assembly 64, the second stage turbine wheel assembly 66 may have a plurality of blades, such as the second stage blade 142, which may be retained to the second stage disk 132 by one or more retainers, such as the second stage retainer 140.

Accordingly, compressed air flows through the manifold 120, the nozzle 122, the manifold 124, the opening 126 in the third labyrinth rim seal 128, the clearance 138, and so on. The second stage disk 132 may be formed of the same material as the first stage disk 68. Also, the first stage retainer 70 and the second stage 140, as well as the first stage blade 72 and the second stage 142, may be ceramic.

Figure 3:
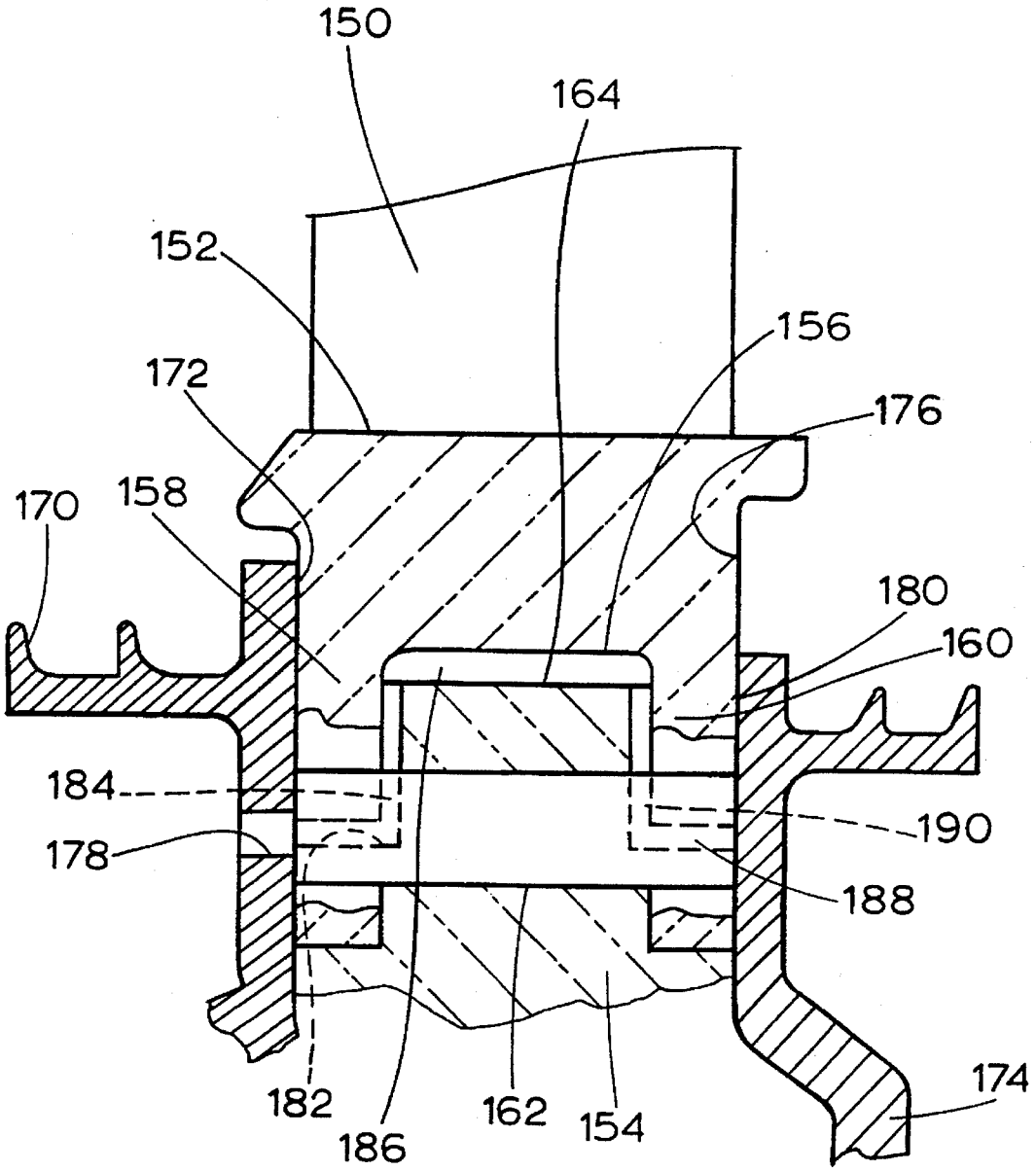
FIG. 3 is an enlarged sectional view of a portion of FIG. 1 and illustrates another embodiment of a sealing arrangement according to the present invention; and, FIG. 4 is a side view of the disk partially shown in FIG. 3.

The present invention may be used with other blade and disk configurations, such as the blade and disk configuration shown in FIG. 3. As shown, in FIG. 3, a blade 150 is retained by a retainer 152 to a disk 154. The retainer 152 has a recess 156 formed by first and second flanges 158 and 160. A pin 162 is inserted through the first and second flanges 158 and 160 of the retainer 152 and through a flange 164 of the disk 154 in order to retain the blade 150 and the retainer 152 on the disk 154.

Figure 4:
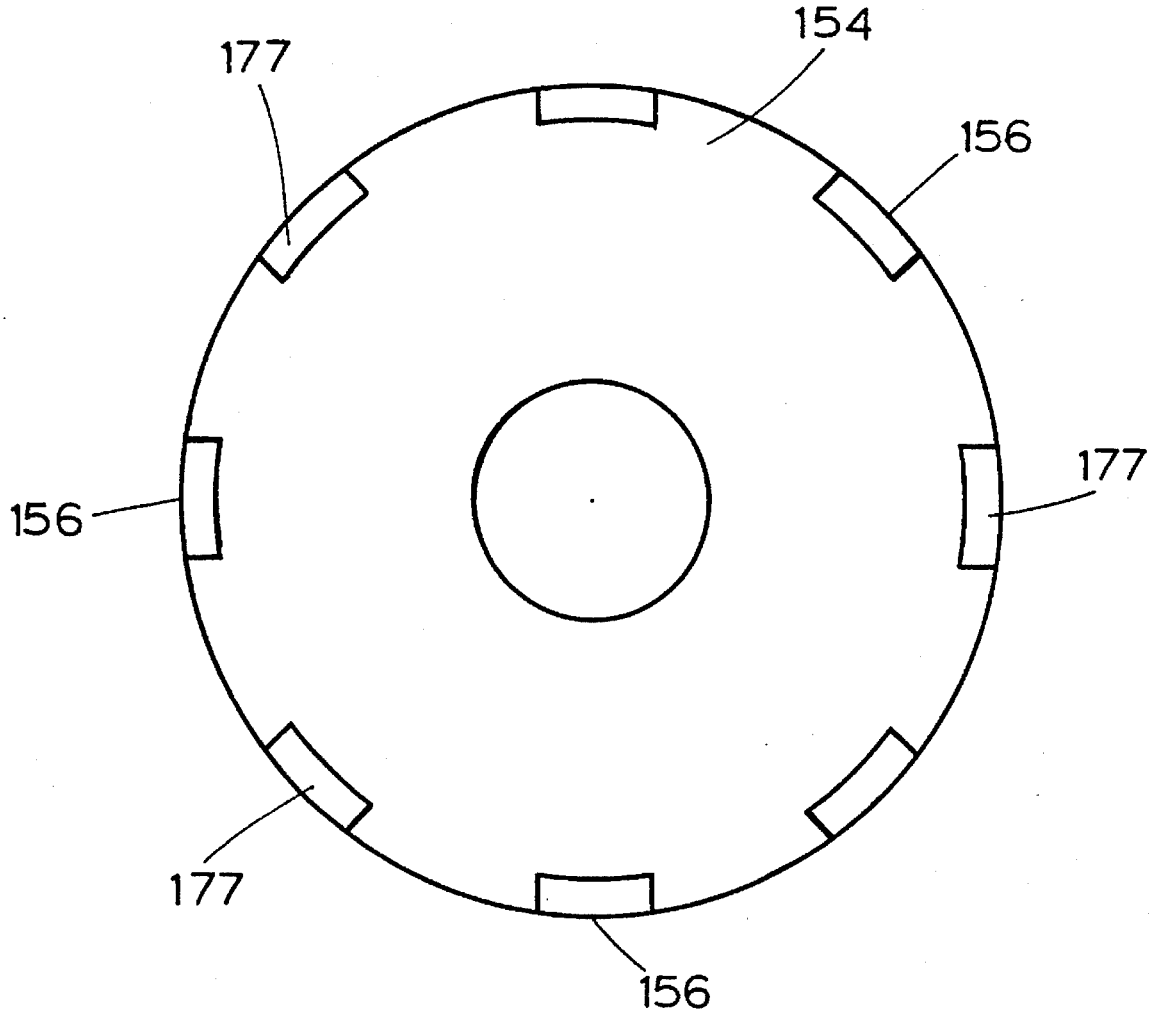

As shown in FIG. 4, the disk 154 may have, for example, a plurality of indentations 177 around each side thereof. The indentations 177 are arranged to receive the flanges 158 and 160 of a plurality of retainers 152 so that a plurality of blades 150 may be attached to the disk 154. The indentations 177 on each side of the disk 154 form a plurality of the flanges 164. Each retainer may receive a pin 162. Alternatively, the retainer 152 and the flange 164 may be annular.

A first rim seal, such as a first labyrinth rim seal 170, is mounted annularly around a first surface 172 formed by the disk 154 and/or retainers 152, and a second rim seal, such as a second labyrinth rim seal 174, is mounted annularly around a second surface 176 formed by the disk 154 and/or retainers 152. The first labyrinth rim seal 170 has an opening 178 therethrough, and there is a channel 180 between the second labyrinth rim seal 174 and each of the retainers 152.

The pin 162 has an axial passageway 182 and a radial passageway 184 cooperating with each other and with the opening 178 through the first labyrinth rim seal 170 to supply compressed air to a clearance 186 between the retainer 152 and the disk 154. Similarly, the pin 162 has an axial passageway 188 and a radial passageway 190 cooperating with each other and with the channel 180 to permit the compressed air to egress from the clearance 186.

Accordingly, compressed air flows through the opening 178 in the first labyrinth rim seal 170, through the axial passageway 182 and the radial passageway 184 in the pin 162, through the clearance 186 between the retainer 152 and the disk 154, through the radial passageway 190 and the axial passageway 188 in the pin 162, and out through the channel 180.

INDUSTRIAL APPLICABILITY

In use, the gas turbine engine 10 is started and allowed to warm up, and is used in any suitable power application. As the demand for load or power is increased, the output of the gas turbine engine 10 is increased by increasing the supply of fuel and subsequent air to the combustor section 20. As a result, the temperature within the gas turbine engine 10 increases. The aerodynamic forces produced by the combustion gases of the combustor section 20 are transferred to the disks 68 and 132 by the corresponding blades 72 and 142. The aerodynamic forces on these blades cause rotation of the corresponding disks in order to provide power to auxiliary equipment such as the compressor section 16 of the gas turbine engine 10.

During operation of the gas turbine engine 10, the ceramic ring and the rim seal expand and shrink at more similar rates than if a metal stator ring were used in place of the ceramic ring. Therefore, the thermal expansion clearance between the ceramic ring and the rim seal can be made small compared to the clearance required between a metal stator ring and a rim seal. Since the thermal expansion clearance can be made small, smaller amounts of hot gas leak from the cavity 86 to the cavity 88.

Thus, because of the use of ceramic rings, such as the ceramic rings 84 and 118, a smaller clearance between the ceramic rings and the rim seals may be provided than if metal stator rings are used in combination with the rim seals. As a result, the rim seals, in cooperation with the ceramic rings, more effectively seal the hot gases in the cavity 86 from the cavity 88 in which the turbine blades are mounted. Thus, only the area adjacent to the rims of the disks requires cooling. Therefore, less compressed air need be diverted for cooling, which increases the efficiency of the gas turbine engine 10 and minimizes performance penalties.

Numerous modifications and alternative embodiments of the present invention will be apparent to those skilled in the art in view of the foregoing description. For example, rim seals may be mounted to, or be part of, blades instead of being mounted directly to disks. As another example, it may be possible to mount a labyrinth seal on the turbine housing and mount a cooperating ring on the disk. Accordingly, this description is to be construed as illustrative only and is for the purpose of teaching those skilled in the art the best mode of carrying out the present invention. The details of the structure may be varied substantially without departing from the spirit of the present invention, and the exclusive use of all modifications which come within the scope of the dependent claims is reserved.

We claim:

1. A turbine wheel assembly comprising:

a blade for reacting to hot gases from a combustor of a turbine engine;

a disk supporting the blade so that the blade and disk rotate in reaction to the hot gases;

a ceramic ring mounted to a turbine housing;

a positioning pin extending at least partially through the ceramic ring and being arranged to permit thermal expansion between the ceramic ring and the turbine housing; and, sealing means proximate to an outer perimeter of the disk and cooperating with the ceramic ring for sealing the hot gases from the disk.

2. The turbine wheel assembly of claim 1 wherein the sealing means comprises a rim seal proximate to the ceramic ring.

3. The turbine wheel assembly of claim 1 wherein the sealing means comprises a labyrinth rim seal having ridges proximate to the ceramic ring.

4. The turbine wheel assembly of claim 1 wherein the disk has a rim proximate to the blade, wherein the blade is supported by the disk so that there is a clearance between the blade and disk, and wherein the turbine wheel assembly further includes coolant supplying means for supplying a coolant to the clearance so as to cool the rim of the disk.

5. The turbine wheel assembly of claim 4 wherein the sealing means comprises a rim seal proximate to the ceramic ring.

6. The turbine wheel assembly of claim 4 wherein the sealing means comprises a labyrinth seal having ridges proximate to the ceramic ring.

7. The turbine wheel assembly of claim 4 wherein the sealing means has an opening cooperating with the clearance between the blade and the disk, and wherein the coolant supplying means directs coolant to the opening of the sealing means.

8. The turbine wheel assembly of claim 7 wherein the sealing means comprises a rim seal proximate to the ceramic ring, and wherein the rim seal has the opening for receiving the coolant so as communicate the coolant to the clearance between the blade and the disk.

9. The turbine wheel assembly of claim 7 wherein the sealing means comprises a labyrinth rim seal having ridges proximate to the ceramic ring, and wherein the labyrinth rim seal has the opening for receiving the coolant so as communicate the coolant to the clearance between the blade and the disk.

10. The turbine wheel assembly of claim 9 wherein the coolant supplying means comprises a nozzle and a nozzle support for supporting the nozzle, wherein the nozzle support and the ceramic ring are arranged to have a thermal expansion clearance therebetween, and wherein the positioning pin is between the nozzle support and the ceramic ring, the positioning pin being arranged to permit thermal expansion between the nozzle support and the ceramic ring.

11. A turbine wheel assembly comprising:

a turbine wheel having a first portion for reacting to aerodynamic forces, and a second portion for spatially locating the first portion, wherein the first and second portions are arranged so that there is a clearance between the first and second portions;

coolant supplying means for supplying a coolant to the clearance so as to cool an interface between the first and second portions, the clearance between the first and second portions being arranged so that coolant enters the clearance at the interface and exits the clearance at the interface;

an annular ceramic ring; and, sealing means for sealing, in cooperation with the annular ceramic ring and the turbine wheel, a cavity containing at least a part of the second portion of the turbine wheel from a cavity containing at least part of the first portion of the turbine wheel, the sealing means including a continuous annular sealing ring cooperating with the ceramic ring for sealing the cavity.

12. The turbine wheel assembly of claim 11 wherein the annular sealing ring is proximate to the annular ceramic ring.

13. The turbine wheel assembly of claim 11 wherein the annular ceramic ring is continuous.

14. The turbine wheel assembly of claim 11 wherein the sealing means has an opening cooperating with the clearance between the first and second portions of the turbine wheel, and wherein the coolant supplying means directs coolant to the opening of the sealing means.

15. The turbine wheel assembly of claim 14 wherein the opening communicates with a first end of the clearance between the first and second portions, wherein a second end of the clearance between the first and second portions communicates with a channel between the sealing means and the first and second portions, and wherein the clearance extends along the interface between its first and second ends.

16. The turbine wheel assembly of claim 14 wherein the annular sealing ring is proximate to the annular ceramic ring, and wherein the annular sealing ring has the opening for receiving the coolant so as to direct coolant to the clearance between the first and second portions of the turbine wheel.

17. The turbine wheel assembly of claim 16 wherein the coolant supplying means comprises a nozzle and a nozzle support for supporting the nozzle, wherein the nozzle support and the annular ceramic ring are arranged to have a thermal expansion clearance therebetween, and wherein the turbine wheel assembly further comprises a positioning pin between the nozzle support and the annular ceramic ring, the positioning pin being arranged to permit thermal expansion between the nozzle support and the annular ceramic ring.

18. A turbine assembly comprising:

a first stage blade for reacting to hot gases from a combustor of a turbine engine;

a first stage disk supporting the first stage blade so that the first stage blade and the first stage disk rotate in reaction to the hot gases;

a first stage ceramic ring mounted to a turbine housing;

a positioning pin between the first stage ceramic ring and the turbine housing, wherein the positioning pin is arranged to permit thermal expansion between the first stage ceramic ring and the turbine housing;

a second stage blade for reacting to the hot gases from the combustor of the turbine engine;

a second stage disk supporting the second stage blade so that the second stage blade and the second stage disk rotate in reaction to the hot gases;

a second stage ceramic ring mounted to the turbine housing;

first stage sealing means proximate to an outer perimeter of the first stage disk and cooperating with the first and second stage ceramic rings for sealing the first stage disk from the hot gases; and, second stage sealing means proximate to an outer perimeter of the second stage disk and cooperating with the second stage ceramic ring for sealing the second stage disk from the hot gases.

19. The turbine assembly of claim 18 wherein the first stage sealing means comprises a first seal cooperating with the first stage ceramic ring and a second seal cooperating with the second stage ceramic ring, and wherein the second stage sealing means comprises a third seal cooperating with the second stage ceramic ring.

20. The turbine assembly of claim 19 wherein the first seal comprises a first labyrinth seal having ridges proximate to the first stage ceramic ring, wherein the second seal comprises a second labyrinth seal having ridges proximate to the second stage ceramic ring, and wherein the third seal comprises a third labyrinth seal having ridges proximate to the second stage ceramic ring.

21. The turbine assembly of claim 18 wherein the first stage disk has a rim proximate to the first stage blade, wherein the first stage blade is supported by the first stage disk so that there is a clearance between the first stage blade and the first stage disk, wherein the turbine assembly further includes first stage coolant supplying means for supplying a coolant to the clearance between the first stage blade and the first stage disk so as to cool the rim of the first stage disk, and wherein the second stage disk has a rim proximate to the second stage blade, wherein the second stage blade is supported by the second stage disk so that there is a clearance between the second stage blade and the second stage disk, wherein the turbine assembly further includes second stage coolant supplying means for supplying a coolant to the clearance between the second stage blade and the second stage disk so as to cool the rim of the second stage disk.

22. The turbine assembly of claim 21 wherein the first stage sealing means comprises a first rim seal cooperating with the first stage ceramic ring and a second rim seal cooperating with the second stage ceramic ring, and wherein the second stage sealing means comprises a third rim seal cooperating with the second stage ceramic ring.

23. The turbine assembly of claim 22 wherein the first rim seal comprises a first labyrinth rim seal having ridges proximate to the first stage ceramic ring, wherein the second rim seal comprises a second labyrinth rim seal having ridges proximate to the second stage ceramic ring, and wherein the third rim seal comprises a third labyrinth rim seal having ridges proximate to the second stage ceramic ring.

24. The turbine assembly of claim 21 wherein the first stage sealing means has an opening cooperating with the clearance between the first stage blade and the first stage disk, and wherein the first stage coolant supplying means directs coolant to the opening of the first stage sealing means, and wherein the second stage sealing means has an opening cooperating with the clearance between the second stage blade and the second stage disk, and wherein the second stage coolant supplying means directs coolant to the opening of the second stage sealing means.

25. The turbine assembly of claim 24 wherein the first stage sealing means comprises a first rim seal cooperating with the first stage ceramic ring and having the opening of the first stage sealing means therein for receiving the coolant from the first stage nozzle so as direct the coolant to the clearance between the first stage blade and the first stage disk, wherein the first stage sealing means comprises a second rim seal cooperating with the second stage ceramic ring, and wherein the second stage sealing means comprises a third rim seal cooperating with the second stage ceramic ring and having the opening of the second stage sealing means therein for receiving the coolant from the second stage nozzle so as direct the coolant to the clearance between the second stage blade and the second stage disk.

26. The turbine assembly of claim 25 wherein the first rim seal comprises a first labyrinth rim seal having ridges proximate to the first stage ceramic ring, wherein the second rim seal comprises a second labyrinth rim seal having ridges proximate to the second stage ceramic ring, and wherein the third rim seal comprises a third labyrinth rim seal having ridges proximate to the second stage ceramic ring.

27. The turbine assembly of claim 26 wherein the first stage coolant supplying means comprises a first stage nozzle and a nozzle support for supporting the first stage nozzle, wherein the nozzle support and the first stage ceramic ring are arranged to have a thermal expansion clearance therebetween, wherein the positioning pin is between the nozzle support and the first stage ceramic ring, the positioning pin being arranged to permit thermal expansion between the nozzle support and the first stage ceramic ring, wherein the second stage coolant supplying means comprises a manifold supported by a second stage nozzle, and wherein the second stage nozzle and the manifold are supported by the second stage ceramic ring.

28. A turbine wheel assembly comprising:

a blade for reacting to hot gases from a combustor of a turbine engine;

a disk supporting the blade so that the blade and disk rotate in reaction to the hot gases, wherein the disk has a rim proximate to the blade and wherein the blade is supported by the disk so that there is a clearance between the blade and the disk;

coolant supplying means for supplying a coolant to the clearance so as to cool an interface between the blade and the disk;

a ceramic ring mounted to a turbine housing; and sealing means proximate to an outer perimeter of the disk and cooperating with the ceramic ring for sealing the hot gases from the disk, wherein the sealing means comprises a labyrinth rim seal having ridges proximate to the ceramic ring, wherein the labyrinth rim seal has an opening cooperating with the clearance between the blade and the disk, wherein the coolant supplying means directs coolant to the opening of the labyrinth rim seal, and wherein the opening of the labyrinth rim seal receives the coolant and communicates the coolant to the clearance between the blade and the disk.

29. A turbine wheel assembly comprising:

a blade for reacting to hot gases from a combustor of a turbine engine;

a disk supporting the blade so that the blade and disk rotate in reaction to the hot gases;

a cylindrical ceramic ring mounted to a turbine housing; and a cylindrical labyrinth rim seal having ridges proximate to the cylindrical ceramic ring and being arranged with the cylindrical ceramic ring so as to seal the hot gases from the disk.

30. The turbine wheel assembly of claim 29 wherein the disk has a rim proximate to the blade, wherein the blade is supported by the disk so that there is a clearance between the blade and disk, and wherein the turbine wheel assembly further includes coolant supplying means for supplying a coolant to the clearance so as to cool the rim of the disk.

31. The turbine wheel assembly of claim 30 wherein the cylindrical labyrinth rim seal has an opening cooperating with the clearance between the blade and the disk, and wherein the coolant supplying means directs coolant to the opening of the cylindrical labyrinth rim seal.

32. The turbine wheel assembly of claim 31 wherein the coolant supplying means comprises a nozzle and supporting means for supporting the nozzle, wherein the supporting means and the cylindrical ceramic ring are arranged to have a thermal expansion clearance therebetween, and wherein the turbine wheel assembly further comprises a positioning pin between the supporting means and the cylindrical ceramic ring, the positioning pin being arranged to permit thermal expansion between the supporting means and the cylindrical ceramic ring.

* * * * *